US007856106B2

(12) United States Patent
Bruno et al.

(10) Patent No.: US 7,856,106 B2
(45) Date of Patent: Dec. 21, 2010

(54) SYSTEM AND METHOD FOR DETERMINING A REPRESENTATION OF AN ACOUSTIC FIELD

(75) Inventors: Rémy Bruno, Vitry sur Seine (FR); Arnaud Laborie, Vitry sur Seine (FR); Sêbastien Montoya, Paris (FR)

(73) Assignee: Trinnov Audio, Villejuif (FR)

( * ) Notice: Subject to any disclaimer, the term of this patent is extended or adjusted under 35 U.S.C. 154(b) by 189 days.

(21) Appl. No.: 10/566,179

(22) PCT Filed: Jul. 29, 2004

(86) PCT No.: PCT/FR2004/002044

§ 371 (c)(1),
(2), (4) Date: Mar. 27, 2006

(87) PCT Pub. No.: WO2005/013643

PCT Pub. Date: Feb. 10, 2005

(65) Prior Publication Data

US 2006/0239465 A1 Oct. 26, 2006

(30) Foreign Application Priority Data

Jul. 31, 2003 (FR) ..... 03 09471

(51) Int. Cl.
*H04R 5/00* (2006.01)

(52) U.S. Cl. ..... 381/17; 381/1; 381/18; 381/92

(58) Field of Classification Search ..... 381/17–18, 381/56, 335–337, 122, 91–92, 26, 304–305, 381/58, 22–23

See application file for complete search history.

(56) References Cited

U.S. PATENT DOCUMENTS 3,158,695 A 11/1964 Camras (Continued)

FOREIGN PATENT DOCUMENTS

WO WO 94/24835 10/1994

OTHER PUBLICATIONS

Arnaud Laborie, Remy Bruno, Sebastien Montoya: "A New Comprehensive Approach of Surround Sound Recording" 114$^{th}$ Convention of the Audio Engineering Society, Convention Paper 5717, Mar. 22, 2003,-Mar. 25, 2003 pp. 1-19, XP002280618 Amsterdam, The Netherlands, p. 5 . . . .

*Primary Examiner*—Devona E Faulk
*Assistant Examiner*—Disler Paul
(74) *Attorney, Agent, or Firm*—Young & Thompson

(57) ABSTRACT

This system for determining a representation of an acoustic field (P) includes:

acoustic wave acquisition elements (1) including a plurality of elemental sensors ($\mathbf{2}_1$ to $\mathbf{2}_Q$) which are distributed in space and which each deliver a measurement signal ($c_1$ to $c_Q$); and elements (8) for processing by the application, to the measurement signals ($c_1$ to $c_Q$), of filtering combinations representative of structural characteristics of the acquisition elements (1) in order to deliver a plurality of acoustic signals ($sc_1$ to $sc_N$) which are each associated with a predetermined general reproduction direction defined relative to a given point in space (14), the set of acoustic signals ($sc_1$ to $sc_N$) forming a representation of the acoustic field (P). The system is characterized in that the elemental sensors ($\mathbf{2}_1$ to $\mathbf{2}_Q$) are distributed in space in a substantially non-regular manner and in that the filtering combinations are representative of that distribution.

21 Claims, 3 Drawing Sheets

U.S. PATENT DOCUMENTS 6,366,679 B1 * 4/2002 Steffen et al. ..... 381/356
6,526,147 B1 * 2/2003 Rung ..... 381/92
6,608,903 B1 * 8/2003 Miyazaki et al. ..... 381/17
6,826,284 B1 * 11/2004 Benesty et al. ..... 381/92
6,845,163 B1 * 1/2005 Johnston et al. ..... 381/92
6,904,152 B1 * 6/2005 Moorer ..... 381/18
7,133,530 B2 * 11/2006 Poletti ..... 381/92
7,289,633 B2 * 10/2007 Metcalf ..... 381/17
7,379,553 B2 * 5/2008 Nakajima et al. ..... 381/92
2003/0063758 A1 * 4/2003 Poletti ..... 381/91
2006/0171547 A1 * 8/2006 Lokki et al. ..... 381/92

* cited by examiner

SYSTEM AND METHOD FOR DETERMINING A REPRESENTATION OF AN ACOUSTIC FIELD

The present invention relates to a method, a device and a system for determining a representation of an acoustic field in the form of a plurality of acoustic or audiophonic signals which are each associated with a predetermined general reproduction direction defined relative to a given point in space.

The determination of such a representation is based on the use of acoustic wave acquisition means comprising a plurality of elemental sensors which are arranged in space and which each deliver a measurement signal.

Those measurement signals are processed by applying filtering combinations, which are representative, in particular, of structural characteristics of the acquisition means and of the predetermined general reproduction directions, in order to obtain the plurality of acoustic signals.

Such a plurality of signals is commonly referred to by the expression "multichannel signal" and corresponds to a plurality of signals, called "channels", which are transmitted in parallel or multiplexed with each other. Each of the signals is intended for a reproduction element or a group of reproduction elements forming an ideal source arranged in a general direction predefined relative to a given point in space.

For example, a conventional multichannel standard known by the name "5.1 ITU-R BF 775-1" comprises five channels intended for reproduction elements placed in five predetermined general directions defined by the angles 0°, +30°, −30°, +110° and −110° relative to the listening centre.

Such an arrangement therefore corresponds to the arrangement of a loudspeaker or a group of loudspeakers at the front in the centre, one on each side at the front on the left and the right and one on each side at the rear on the left and the right.

The application of the acoustic signals to reproduction elements arranged in appropriate predetermined general directions theoretically permits the reproduction of an acoustic field.

Acquisition and processing constitute key elements in the quality of this reproduction.

Some existing acquisition means are formed by a set of directional elemental sensors where each sensor delivers directly a channel corresponding to one of the predetermined general reproduction directions. In that case, each sensor is substantially oriented in the direction corresponding to its associated channel.

The quality of the representation obtained with such acquisition means is limited by the intrinsic directivity of the sensors, because no processing is carried out, so that the representation is not a representation of high quality.

Other techniques, such as the techniques grouped under the term "ambisonic", are based on a modeling of the acquisition means in the form of a punctiform set of elemental and directional sensors so as to consider only the directions of origin of the sounds relative to the centre of the acquisition means.

However, the impossibility of positioning the set of elemental sensors at the same point, the absence of elemental sensors having enhanced directivity characteristics and also the simplicity of the processing carried out, such as gain matrices, restrict these technologies to a representation whose quality is limited to the level of precision commonly referred to as "order 1" on the basis of the spherical harmonics.

Finally, the system described in the article entitled "Circular microphone array for discrete multichannel audio recording", presented on 22 Mar. 2003 at the 114$^{th}$ convention of the AES, uses a circular regular network of 288 cardioid microphones. Complex processing in several steps of all of the signals delivered by this network of sensors enables a high-quality representation of the acoustic field to be obtained.

It therefore appears that the existing acquisition and processing means require a large amount of regularly distributed elemental sensors and also complex processing in order to arrive at a high-quality representation of the acoustic field in a multichannel format.

This substantially reduces the portability of these systems and increases the cost of implementation and the calculation times.

The object of the invention is to solve those problems by providing a method, a device and a system for determining a high-quality representation of an acoustic field in a multichannel format, which are of enhanced portability and rapidity and which are inexpensive.

To that end, the invention relates to a system for determining a representation of an acoustic field of the type comprising:

acoustic wave acquisition means comprising a plurality of elemental sensors which are distributed in space and which each deliver a measurement signal; and means for processing by the application, to the measurement signals, of filtering combinations representative of structural characteristics of the acquisition means in order to deliver a plurality of acoustic signals which are each associated with a predetermined general reproduction direction defined relative to a given point in space, the set of acoustic signals forming a representation of the acoustic field, characterized in that the elemental sensors are distributed in space in a substantially non-regular manner and in that the filtering combinations are representative of that distribution.

According to other features:

the acquisition means are such that, for all of the usual coordinate systems, for at least one of the coordinates of the coordinate system, the values of the coordinates of the positions of all of the elemental sensors are distributed on distinct values and at a non-constant pitch;

the acquisition means comprise at least one omnidirectional elemental sensor;

the acquisition means comprise at least one elemental sensor whose directivity is a combination of omnidirectional and bidirectional patterns;

the acquisition means comprise a number of elemental sensors of one to five times the number of predetermined general reproduction directions;

the processing means comprise a single matrix filtering stage receiving as an input the measurement signals and delivering as an output the plurality of acoustic signals;

the processing means form weighted linear combinations of the measurement signals in order to form the acoustic output signals;

the processing means permit the application of filtering combinations which vary with the frequency of the measurement signals processed.

The invention relates also to a device for determining a representation of an acoustic field, which device comprises means for processing the signals delivered by acoustic wave acquisition means comprising a plurality of elemental sensors distributed in space, by applying filtering combinations representative of structural characteristics of the acquisition means in order to deliver a plurality of acoustic signals which are each associated with a predetermined general reproduction direction defined relative to a given point in space, the acoustic signals forming a representation of the acoustic field, characterized in that the processing means are suitable for processing signals delivered by acquisition means formed by sensors distributed in space in a substantially non-regular manner.

The invention relates also to a method for determining a representation of an acoustic field, characterized in that it comprises:

a step of acquiring, at a plurality of points distributed in space in a substantially non-regular manner, the acoustic field by acoustic wave acquisition means in order to deliver a plurality of measurement signals which are representative at each point, in amplitude and in phase, of the acoustic field;

a step of processing by applying, to the measurement signals, filtering combinations representative of structural characteristics of the acquisition means in order to deliver a plurality of acoustic signals which are each associated with a predetermined general reproduction direction defined relative to a given point in space, the set of acoustic signals forming a representation of the acoustic field.

According to other features of the method of the invention, the processing step corresponds to:

the application to the measurement signals of filtering combinations in order to generate a plurality of processed signals constituting a representation of the acoustic field which is substantially independent of the structural characteristics of the acquisition means, in the form of a finite number of Fourier-Bessel coefficients; and the application to the processed signals of specific linear combinations in order to generate the corresponding plurality of acoustic signals;

the processing step corresponds to the application of filtering combinations in accordance with a technique selected from the group formed:

by filtering techniques in the frequency domain;

by filtering techniques in the temporal domain by impulse response; and by filtering techniques in the temporal domain by means of infinite impulse response recursive filters.

The invention relates also to a method for checking the non-regular character of a network of elemental sensors, characterized in that it consists:

in considering the network in a first usual coordinate system;

in checking the values of the positions of all of the sensors in accordance with a first coordinate of the coordinate system;

if the values of the first coordinates are neither constant nor distributed at regular intervals, the network is called non-regular in the current coordinate system and the method is repeated in another coordinate system;

if the values of the first coordinates are either constant or distributed at regular intervals, the values of the positions of the sensors are checked in accordance with a second coordinate of the coordinate system;

if the values of the second coordinates are neither constant nor distributed at regular intervals, the network is non-regular in the current coordinate system and the method is repeated with another coordinate system;

if the values of the second coordinates are either constant or distributed at regular intervals, the values of the positions of the sensors are checked in accordance with a third coordinate of the coordinate system;

if the values of the third coordinates are neither constant nor distributed at regular intervals, the network is non-regular in the current coordinate system and the method is repeated in another coordinate system;

if, for the first, second and third coordinates, the values of the coordinates of the positions of all of the sensors are either constant or distributed at regular intervals, the network is regular in the current coordinate system;

if, in any one of the usual coordinate systems, the network is regular, it is called regular; and if the network is non-regular in each of the usual coordinate systems, it is called non-regular.

The invention will be better understood on reading the following description which is given purely by way of example and with reference to the appended drawings in which:

FIG. 1 shows a conventional spherical coordinate system in order to clarify the coordinate system to which reference is made in the text.

Figure 1:
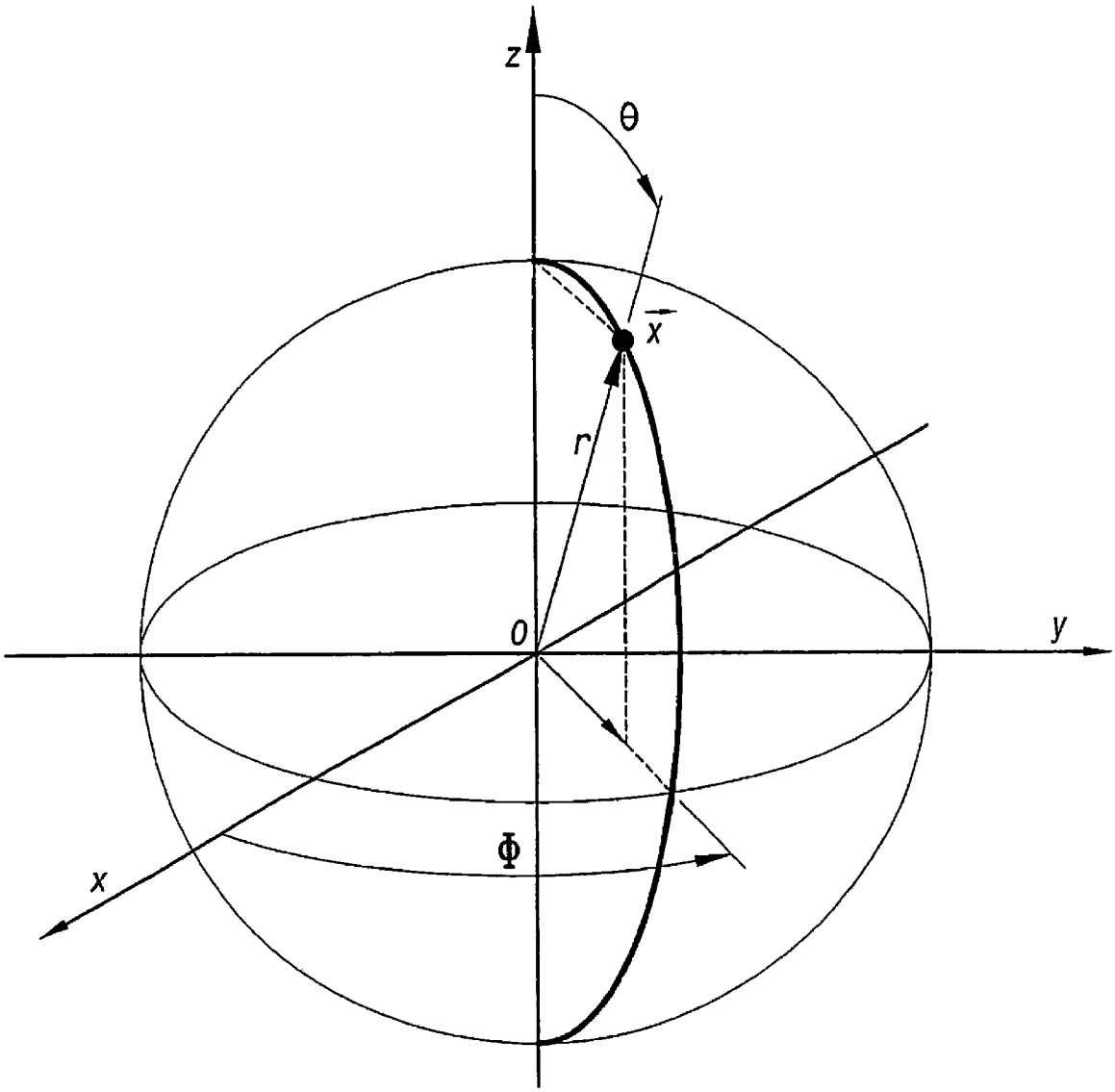
FIG. 1 is a representation of a spherical coordinate system.

This coordinate system is an orthonormal coordinate system having an origin O and comprising three axes (OX), (OY) and (OZ). In this coordinate system, a position indicated $\vec{x}$ is described by means of it spherical coordinates $(r,\theta,\phi)$, where r denotes the distance relative to the origin O, $\theta$ the orientation in the vertical plane and $\phi$ the orientation in the horizontal plane.

In such a coordinate system, an acoustic field is known if the acoustic pressure indicated $p(r,\theta,\phi,t)$, whose Fourier transform is indicated $P(r,\theta,\phi,f)$ where f denotes the frequency, is defined at all points at each instant t.

The method of the invention is based on the use of spatio-temporal functions enabling any-acoustic field to be described in time and in the three spatial dimensions.

In the embodiments described, these functions are what are known as spherical Fourier-Bessel functions of the first kind which will be referred to hereinafter as Fourier-Bessel functions.

In a region empty of sources and empty of obstacles, the Fourier-Bessel functions correspond to the solutions of the wave equation and constitute a basis which generates all of the acoustic fields produced by sources located outside this region.

Any three-dimensional acoustic field can therefore be expressed by a linear combination of the Fourier-Bessel functions in accordance with the expression of the inverse Fourier-Bessel transform which is expressed:

$$P(r,\theta,\phi,f)=4\pi\sum_{l=0}^{\infty}\sum_{m=-1}^{l}P_{l,m}(f)j^{l}j_{l}(kr)y_{l}^{m}(\theta,\phi)$$

In that equation, the terms $P_{l,m}(f)$ are defined as the Fourier-Bessel coefficients of the field $p(r,\theta,\phi,t)$, $$k=\frac{2\pi f}{c},$$

c is the speed of sound in air (340 $ms^{-1}$), $j_l(kr)$ is the spherical Bessel function of the first kind and of order l defined by $$j_l(x) = \sqrt{\frac{\pi}{2x}}\, J_{l+1/2}(x)$$

where $J_v(x)$ is the Bessel function of the first kind and of order v, and $y_l^m(\theta,\phi)$ is the real spherical harmonic of order l and of term m, with m ranging from −l to l, defined by:

$$y_l^m(\theta, \phi) = P_l^{|m|}(\cos\theta) trg_m(\phi)$$

with:

$$trg_m(\phi) = \begin{cases} \frac{1}{\sqrt{\pi}}\cos(m\phi) & \text{pour } m > 0 \\ \frac{1}{\sqrt{2\pi}} & \text{pour } m = 0 \\ \frac{1}{\sqrt{\pi}}\sin(m\phi) & \text{pour } m < 0 \end{cases}$$

In this equation, the $P_m(x)$ are the associated Legendre functions defined by:

$$P_l^m(x) = \sqrt{\frac{2l+1}{2}}\sqrt{\frac{(l-m)!}{(l+m)!}}\,(1-x^2)^{m/2}\frac{d^m}{dx^m}P_l(x)$$

with $P_l(x)$ denoting the Legendre polynomials, defined by:

$$P_l(x) = \frac{1}{2^l \cdot l!}\frac{d^l}{dx^l}(x^2-1)^l$$

The Fourier-Bessel coefficients are also expressed in the temporal domain by the coefficients $p_{l,m}(t)$ corresponding to the inverse temporal Fourier transform of the coefficients $P_{l,m}(f)$.

In other embodiments, the acoustic field is broken down on the basis of functions, where each of the functions is expressed by an optionally infinite linear combination of Fourier-Bessel functions.

Figure 2:
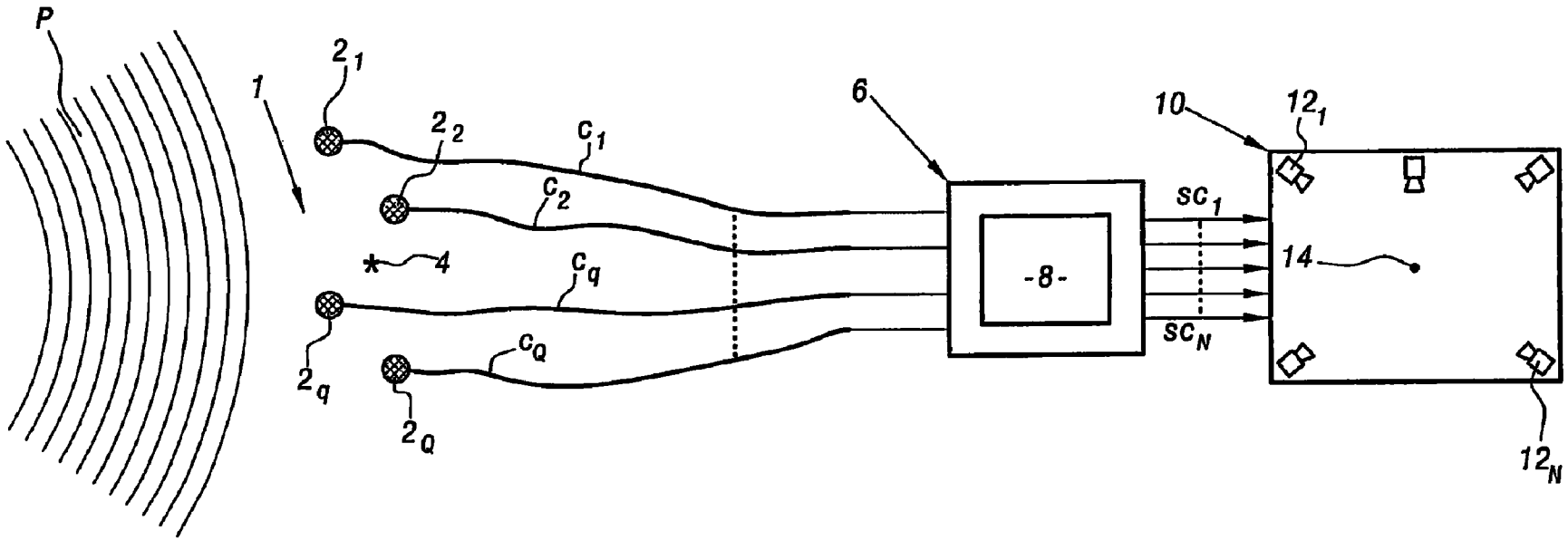
FIG. 2 is a block diagram of a reproduction system according to the invention.

FIG. 2 shows schematically a system according to the invention.

This system comprises acquisition means 1 formed by Q elemental sensors $\mathbf{2}_1$ to $\mathbf{2}_Q$ delivering measurement signals $c_1(t)$ to $c_Q(t)$, also indicated $c_1$ to $c_Q$, which are introduced into a device 6 for determining a representation of an acoustic field.

The device 6 comprises processing means 8 suitable for applying to the measurement signals $c_1$ to $c_Q$ filtering combinations representative of structural characteristics of the acquisition means 1, in order to deliver as an output a plurality of acoustic signals which are each associated with a predetermined general reproduction direction defined relative to a given point in space.

The acoustic signals $sc_1(t)$ to $sc_N(t)$, also indicated $sc_1$ to $sc_N$, delivered by the device 6, are then transmitted to reproduction means 10 comprising N reproduction elements $\mathbf{12}_1$ to $\mathbf{12}_N$ arranged in predetermined directions relative to a given point 14 in space, corresponding to the centre of the reproduction means 10.

The control of these reproduction elements $\mathbf{12}_1$ to $\mathbf{12}_N$ by the acoustic signals $sc_1$ to $sc_N$, enables the acoustic field picked up by the acquisition means 1 to be reproduced.

Preferably, the processing means 8 of the device 6 are configured beforehand and are associated specifically with a set of elemental sensors $\mathbf{2}_1$ to $\mathbf{2}_Q$ forming the acquisition means 1 and with a set of reproduction elements forming the reproduction means 10.

Advantageously, however, the processing means 8 comprise a plurality of filtering combinations which correspond to different acquisition means and/or to different output formats and which can be selected by a user, for example directly by means of a switch or through a control interface.

The device 6 may be in the form of electronic equipment dedicated to the implementation of the invention or in the form of software comprising program code instructions which are to be executed by equipment comprising a processor and means for interfacing with acquisition means and reproduction means.

For example, the device 6 is formed by a computer associated with suitable interface cards.

The elemental sensors $\mathbf{2}_1$ to $\mathbf{2}_Q$ are located at known points in space around a predetermined point 4 designated as the centre of the acquisition means 1.

Thus, the position $(r_q,\theta_q,\phi_q)$ of each elemental sensor $\mathbf{2}_q$ is expressed in space in a spherical coordinate system, such as that described with reference to FIG. 1, centred on the centre 4 of the acquisition means 1.

According to the invention, the elemental sensors $\mathbf{2}_1$ to $\mathbf{2}_Q$ are distributed in space in a substantially non-regular manner.

For a given configuration, or a network, to be regarded as non-regular in space, it is necessary, for all of the usual three-dimensional coordinate systems, whether they be Cartesian, cylindrical or spherical, for at least one of the coordinates of the coordinate system, that the values of the coordinates of the positions of all of the elemental sensors should be neither constant nor distributed at a constant pitch, that is to say, distributed on distinct values and at a non-constant pitch.

Or, a configuration is non-regular if, for all of the usual coordinate systems, for at least one of the three coordinates of the coordinate system, the values of the coordinates of the positions of all of the sensors are distributed in a non-zero spatial domain or interval and with a variable deviation of the coordinates taken in succession.

Thus, configurations in which the sensors are arranged at regular intervals along a line or circle, at the intersections of an imaginary flat grid or at the intersections of an imaginary cubic mesh, are regular configurations.

It will be appreciated that the evaluation of such a non-regular distribution must take into account a tolerance resulting from the constraints of physical production and the constraints associated with the dimensioning of the elemental sensors used.

Therefore, the coordinates of the sensors must be distributed in an interval greater than a tolerance interval and must have deviations beyond that tolerance interval.

In general, the position of a sensor corresponds to the position of the centre of its sensitive portion and a tolerance interval in each spatial direction is defined around that position.

Advantageously, the tolerance interval for a set of elemental sensors forming the acquisition means corresponds to a distance equivalent to one quarter of the distance between the two elemental sensors that are closest together. For example, such a distance is of the order of 2 cm, so that the tolerance interval corresponds approximately to 0.5 cm.

Conversely, a configuration is considered to be regular if, in one of the usual coordinate systems, for the three coordinates of that system, the values of coordinates of the positions of all of the sensors are constant or distributed at a constant pitch.

Or, a configuration is regular if, in one of the usual coordinate systems, for all of the coordinates of that system, the values of coordinates of the positions of all of the sensors are distributed in a substantially zero interval or with a substantially constant successive deviation.

In addition, sensors that have a substantially non-zero physical space requirement and that are placed next to one another form a punctiform or almost punctiform distribution which is regarded as a regular configuration.

The following method makes it possible to determine whether a given configuration of elemental sensors is regular or non-regular.

The above-mentioned configuration is considered with reference to a first of the three usual coordinate systems, such as the three-dimensional Cartesian coordinate system.

The values of the positions of all of the sensors are then checked in accordance with a first coordinate of the coordinate system, such as the abscissa. If those values are neither constant nor distributed at regular intervals, taking into account a tolerance interval, then the configuration is non-regular in this coordinate system and the procedure is started again with another coordinate system.

If the values of these first coordinates are either constant or distributed at regular intervals, the values of the positions of the sensors are checked in accordance with a second coordinate of the coordinate system, such as the ordinate.

If the values of these second coordinates are neither constant nor distributed at regular intervals, the configuration is non-regular in this coordinate system and the procedure is started again with another coordinate system.

Conversely, if the values of these coordinates are either constant or distributed at regular intervals, the values of the positions of the sensors are checked in accordance with the third and last coordinate of the coordinate system, such as that according to a vertical axis called the zenith coordinate.

If the values of these third coordinates are neither constant nor distributed at regular intervals, the configuration is non-regular in this coordinate system and the procedure is started again with another coordinate system.

In the opposite case, in this coordinate system, for all of the coordinates, the values of the coordinates of the positions of all of the sensors are either constant or distributed at regular intervals. Therefore, the configuration is regular in this coordinate system.

At the end of the tests in the three usual coordinate systems, if the configuration is regular in one of the three coordinate systems, it is called regular. Conversely, if the configuration is non-regular in the three coordinate systems, it is called non-regular.

Such a substantially non-regular distribution avoids the redundancy of the data sampled by the elemental sensors in the acoustic field, with the result that a reduced number of sensors is necessary.

Advantageously, the maximum number Q of elemental sensors is less than or equal to five times the number of acoustic signals forming the representation of the acoustic field at the end of the processing operation.

Furthermore, the distribution of the elemental sensors $\mathbf{2}_q$ in space may comply with specific rules while at the same time complying with the criteria of non-regularity such as defined above.

Advantageously, the acquisition means 1 reproduce the general geometrical characteristics of the reproduction means 10, such as a planar arrangement and a given symmetry, while respecting the criteria of non-regularity.

Figure 3:
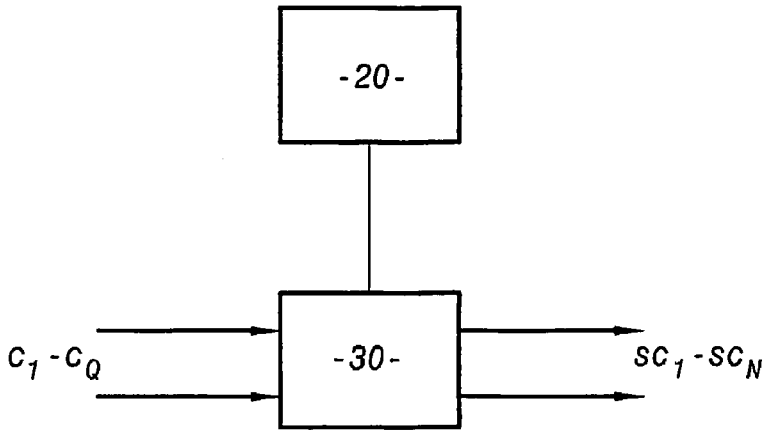
FIG. 3 is a flow chart of the method of the invention.
Figure 4:
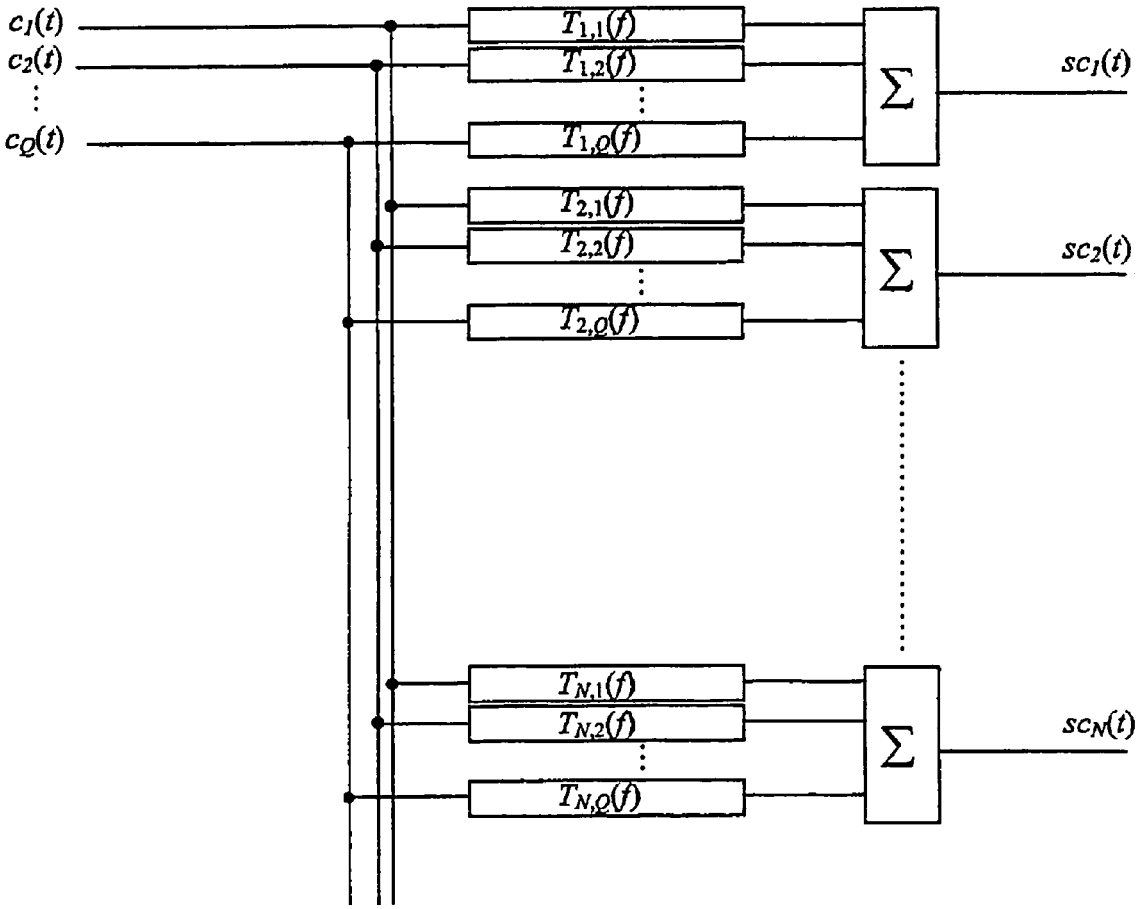
FIG. 4 is a detailed representation of the processing performed by the invention.

With reference to FIGS. 3 and 4, a description will now be given of the operation of the system of the invention.

Before implementing the invention, the acquisition means 1 are arranged in space in a substantially non-regular manner.

During a first step 20 of acquisition, the system of the invention is exposed to an acoustic field P and each sensor $\mathbf{2}_q$ of the acquisition means 1 delivers a measurement signal $c_q(t)$ which corresponds to the measurement made by that sensor in the acoustic field P.

The acquisition means 1 therefore deliver a plurality of measurement signals of the acoustic field $c_1(t)$ to $c_Q(t)$, which are associated directly with the acquisition capacities of the elemental sensors $\mathbf{2}_1$ to $\mathbf{2}_Q$.

The method then includes a step 30 of processing by the application of filtering combinations to the measurement signals $c_1$ to $c_Q$ delivered by the acquisition means 1.

As indicated above, these filtering combinations are representative of the structural characteristics of the acquisition means 1 and are suitable for delivering a plurality of acoustic signals $sc_1$ to $sc_N$ which are each associated with a predetermined general reproduction direction defined relative to a given point in space.

More especially, the N channels $sc_1(t)$ to $sc_N(t)$ are obtained from the Q measurement signals $c_1(t)$ to $c_Q(t)$ by means of a single matrix filtering involving N×Q filters varying as a function of the frequency, and indicated $T_{n,q}(f)$. Each output channel $sc_1(t)$ is obtained by filtering each of the measurement signals $c_1(t)$ to $c_Q(t)$ and by applying a linear combination to the signals thus filtered.

Each filter $T_{n,q}(f)$ is therefore representative of the contribution of the measurement signal $c_q(t)$ in the constitution of the channel $sc_n(t)$. The channels are obtained in accordance with the relationship:

$$SC_n(f) = \sum_{q=1}^{Q} T_{n,q}(f) C_q(f)$$

In that relationship, $SC_n(f)$ is the Fourier transform of $sc_n(t)$ and $C_q(f)$ is the Fourier transform of $c_q(t)$.

The filters $T_{n,q}(f)$ may be organized in a matrix T of size N×Q in the following manner:

$$T = \begin{bmatrix} T_{1,1}(f) & T_{1,2}(f) & \cdots & T_{1,Q}(f) \\ T_{2,1}(f) & T_{2,2}(f) & \cdots & T_{2,Q}(f) \\ \vdots & \vdots & & \vdots \\ T_{N,1}(f) & T_{N,2}(f) & \cdots & T_{N,Q}(f) \end{bmatrix}$$

In the embodiment described, the matrix T is obtained by means of the following matrix relationship:

$$T=DE$$

In that equation, E is an encoding matrix representative of the characteristics of the acquisition means 1 and in particular of their spatial configuration. The matrix E makes it possible to obtain a representation, in Fourier Bessel coefficients, of an acoustic field $\tilde{P}$ corresponding to an estimate of the acoustic field P in which the elemental sensors $\mathbf{2}_1$ to $\mathbf{2}_Q$, are immersed, on the basis of the measurement signals $c_1(t)$ to $c_Q(t)$. The matrix E has the size $(L+1)^2 \times Q$, the coefficient L corresponding to the order at which the encoding is carried out and to the maximum resolution that the encoding enables to be achieved. The matrix E is obtained by means of the relationship:

$$E=\mu B^T(\mu BB^T+(1-\mu)I_N)^{-1}$$

In that equation, the coefficient μ specifies a compromise between the fidelity of representation of the acoustic field $\tilde{P}$ and the minimization of the background noise introduced by the elemental sensors $\mathbf{2}_1$ to $\mathbf{2}_Q$ and may assume any of the values between 0 and 1. Thus, if μ=0, the background noise is minimal and if μ=1, the spatial quality is maximum.

Advantageously, the parameters L and μ can vary with the frequency.

In that relationship, B is a spatial sampling matrix of size $Q \times (L+1)^2$ whose elements $B_{q,l,m}(f)$ are organized in the following manner:

$$\begin{bmatrix} B_{1,0,0}(f) & B_{1,1,-1}(f) & B_{1,1,0}(f) & B_{1,1,1}(f) & \cdots & B_{1,L,-L}(f) & \cdots & B_{1,L,0}(f) & \cdots & B_{1,L,L}(f) \\ B_{2,0,0}(f) & B_{2,1,-1}(f) & B_{2,1,0}(f) & B_{2,1,1}(f) & \cdots & B_{2,L,-L}(f) & \cdots & B_{2,L,0}(f) & \cdots & B_{2,L,L}(f) \\ \vdots & \vdots & \vdots & \vdots & & \vdots & & \vdots & & \vdots \\ B_{Q,0,0}(f) & B_{Q,1,-1}(f) & B_{Q,1,0}(f) & B_{Q,1,1}(f) & \cdots & B_{Q,L,-L}(f) & \cdots & B_{Q,L,0}(f) & \cdots & B_{Q,L,L}(f) \end{bmatrix}$$

If all of the elemental sensors $\mathbf{2}_1$ to $2_Q$ are sensors of the omnidirectional type, the term B is expressed in the following manner:

$$B_{q,l,m}(f)=4\pi j^l j_l(kr_q)y_l^m(\theta_q,\phi_q)$$

In that relationship, $(r_q,\theta_q,\phi_q)$ is the position of the sensor $\mathbf{2}_q$ in the spherical coordinate system described with reference to FIG. 1.

In other embodiments, each sensor $\mathbf{2}_q$ is placed at the position $(r_q,\theta_q,\phi_q)$, has a directivity composed of a combination of omnidirectional and bidirectional patterns of proportion $d_q$ and is oriented in the direction $(\theta_q^{\alpha},\phi_q^{\alpha})$, so that the sensor $\mathbf{2}_q$ has a maximum sensitivity in the direction $(\theta_q^{\alpha},\phi_q^{\alpha})$. In that case, the elements $B_{q,l,m}(f)$ are obtained in the following manner:

$$B_{n,l,m}(f) = 4\pi j^l \times \{(1-d_q)j_l(kr_q)y_l^m(\theta_q,\phi_q) - jd_q \times \left(j_l^*(kr_q)y_l^m(\theta_q,\phi_q)u_r - \frac{j_l(kr_q)}{kr_q}R_l^{|m|}(\cos\theta_q)trg_m(\phi_q)u_\theta + \frac{mj_l(kr_q)}{kr_q\sin\theta_q}y_l^{-m}(\theta_q,\phi_q)u_\phi\right)\}$$

where:

$$j_l^*(kr_q) = \frac{lj_{l-1}(kr_q)-(l+1)j_{l+1}(kr_q)}{2l+1}$$

$$R_l^m(\cos\theta_q) = \begin{cases} \sqrt{l(l+1)P_l^1(\cos\theta_q)} & \text{pour } m=0 \\ \frac{\sqrt{(l-m)(l+m+1)}}{2}P_l^{m+1}(\cos\theta_q) - \frac{\sqrt{(l+m)(l-m+1)}}{2}P_l^{m-1}(\cos\theta_q) & \text{pour } 1 \le m \le l-1 \\ -\sqrt{\frac{l}{2}}\,P_l^{l-1}(\cos\theta_q) & \text{pour } m=l \end{cases}$$

and where:

$$u_r=\sin\theta_q \sin\theta_q^{\alpha}\cos(\phi_q-\phi_q^{\alpha})+\cos\theta_q\cos\theta_q^{\alpha}$$
$$u_\theta=\cos\theta_q \sin\theta_q^{\alpha}\cos(\phi_q-\phi_q^{\alpha})-\sin\theta_q\cos\theta_q^{\alpha}$$
$$u_\phi=\sin\theta_q^{\alpha}\sin(\phi_q^{\alpha}-\phi_q)$$

If the acquisition means 1 comprise only cardioid sensors, the parameter $d_q$ assumes the value ½ for the Q sensors.

In general, the matrix indicated E is therefore representative of the position of the elemental sensors $\mathbf{2}_1$ to $2_Q$.

The determination of E does not impose any constraint on the position $(r_q,\theta_q,\phi_q)$ of the sensors and in particular enables the non-regular configurations to be taken into account. Such non-regular configurations are more efficient because they permit the sampling of more data on the initial field P, dispensing with the redundancies introduced by the regular configurations.

In the equation expressing T, the filtering matrix D is a decoding matrix representative of the predetermined general reproduction directions selected. The matrix D makes it possible to determine the control signals permitting the high-precision reproduction of the estimated acoustic field $\tilde{P}$ and therefore of the acquired acoustic field P. The matrix D is of size $N \times (L+1)^2$ and is obtained by means of the following matrix relationship:

$$D=(M^TWM)^{-1}M^TW$$

W is a matrix corresponding to a spatial window defining the volume in which the reproduction is to be carried out. It is a diagonal matrix of size $(L+1)^2$ which contains weighting coefficients $W_l$ and in which each coefficient $W_l$ is found 2l+1 times in succession on the diagonal. The matrix W therefore has the following form:

$$W = \begin{bmatrix} W_0 & 0 & \cdots & \cdots & \cdots & \cdots & \cdots & 0 \\ 0 & W_1 & \ddots & & & & & \vdots \\ \vdots & \ddots & W_1 & \ddots & & & & \vdots \\ \vdots & & \ddots & W_1 & \ddots & & & \vdots \\ \vdots & & & \ddots & \ddots & \ddots & & \vdots \\ \vdots & & & & \ddots & W_L & \ddots & \vdots \\ \vdots & & & & & \ddots & \ddots & 0 \\ 0 & \cdots & \cdots & \cdots & \cdots & \cdots & 0 & W_L \end{bmatrix}$$

In the embodiment described, the values assumed by the coefficients $W_l$ correspond to the values of a function such as a Hamming window of size 2L+1 evaluated in l, so that the parameter $W_l$ is determined for l ranging from 0 to L.

M is a matrix corresponding to the predetermined general reproduction directions, in other words, to the output multichannel format. It is a matrix of size $(L+1)^2$ by N, constituted by elements $M_{l,m,n}$, the indices l,m denoting the line $l^2+l+m$ and n denoting the column n. The matrix M therefore has the following form:

$$\begin{bmatrix} M_{0,0,1} & M_{0,0,2} & \cdots & M_{0,0,N} \\ M_{1,-1,1} & M_{1,-1,2} & \cdots & M_{1,-1,N} \\ M_{1,0,1} & M_{1,0,2} & \cdots & M_{1,0,N} \\ M_{1,1,1} & M_{1,1,2} & \cdots & M_{1,1,N} \\ \vdots & \vdots & & \vdots \\ M_{L,-L,1} & M_{L,-L,2} & \cdots & M_{L,-L,N} \\ \vdots & \vdots & & \vdots \\ M_{L,0,1} & M_{L,0,2} & \cdots & M_{L,0,N} \\ \vdots & \vdots & & \vdots \\ M_{L,L,1} & M_{L,L,2} & \cdots & M_{L,L,N} \end{bmatrix}$$

In the embodiment described, the elements $M_{l,m,n}$ are obtained starting from the multichannel format in accordance with the relationship:

$$M_{l,m,n}=y_l^m(\theta_n,\phi_n)$$

where $(\theta_n,\phi_n)$ corresponds to the general direction associated with the channel $sc_n(t)$ in the multichannel format.

The processing step 30 therefore corresponds to the application, to the set of measurement signals $c_1$ to $c_Q$, of filtering combinations for generating a plurality of processed signals constituting a representation $\tilde{P}$ of the acoustic field P), which representation is substantially independent of the structural characteristics of the acquisition means 1, in the form of a finite number of Fourier-Bessel coefficients.

Step 30 also corresponds to the application, to the processed signals, of specific linear combinations for generating the corresponding plurality of acoustic signals $sc_1$ to $sc_N$.

FIG. 4 shows schematically the implementation of the processing step 30 carried out by the means 8 described above.

The filters $T_{n,q}(f)$ are applied to the measurement signals $c_1(t)$ to $c_N(t)$ by means of the usual filtering methods, such as, for example:

filtering in the frequency domain, such as, for example, block convolution techniques;

filtering in the temporal domain by impulse response; and filtering in the temporal domain by means of infinite impulse response recursive filters.

The N output signals $sc_1(t)$ to $sc_N(t)$ obtained at the end of the processing of the invention are representative of an acoustic field $\hat{P}$ which is reproduced by connecting each channel $sc_n(t)$ to the corresponding reproduction element $\mathbf{12}_n$ emitting plane direction waves $(\theta_d,\phi_n)$ according to the specifications of the multichannel format. The simultaneous action of the N reproduction elements $\mathbf{12}_1$ to $\mathbf{12}_N$ controlled by the channels $sc_1(t)$ to $sc_N(t)$, respectively, enable the acoustic field $\hat{P}$ to be reproduced.

Thanks to the processing carried out and corresponding to the filtering matrix T, the representation of the acoustic field $\hat{P}$ in multichannel format is close to the acoustic field P in which the sensors $\mathbf{2}_q$ are immersed. It appears that the matrix T is obtained by manipulating acoustic field descriptions broken down at a high order and leads to a high-quality representation of the acoustic field.

It therefore appears that the use of a substantially non-regular distribution of the elemental sensors enables each of the sensors to be marked out and enables more spatial data on the acoustic field to be sampled.

Thanks to the processing of the invention, all of these data can be reproduced in the best possible manner in order to obtain a high-quality representation in multichannel format with a small number of elemental sensors.

In particular, in the case of reproduction of the type referred to as 5.1, as described above, the number of elemental sensors is, for example, less than 25 and preferably less than 10.

It will be appreciated that numerous embodiments are possible.

In particular, other types of sensor may be used by modifying the equations as a function of the nature thereof. For example, all or some of the elemental sensors may be omnidirectional and/or cardioid sensors.

The invention claimed is:

1. A system for determining reproduction signals of an acoustic field, comprising:

a plurality of elemental sensors for measuring the acoustic field and for delivering measurements signals, each elemental sensor having a three-dimensional position, a processing device for processing, according to the three-dimensional positions of the elemental sensors, the measurement signals in order to deliver a plurality of reproduction signals forming a representation of the acoustic field, wherein each reproduction signal is associated with a reproduction direction with respect to a given point in space, wherein the reproduction signals make reproduction elements reproduce the acoustic field upon each reproduction signal being delivered to a respective reproduction element orientated according to the reproduction direction associated with the reproduction signal, wherein the elemental sensors are distributed in space at respective positions with respect to a center of the elemental sensors, according to a substantially non-regular distribution, in which, for the following three-dimensional coordinate systems: Cartesian, cylindrical or spherical, for at least one of the coordinates of the coordinate system, the values of the coordinates of the positions of all of the elemental sensors are distributed on distinct values and at a non-constant pitch, wherein the processing device comprise a single filtering matrix T, receiving as an input the measurement signals and delivering as an output the reproduction signals, and wherein T=DE, where:

E is an encoding matrix representative of the spatial configuration of an acquisition means, and D is a decoding matrix representative of the predetermined general reproduction directions.

2. The system according to claim 1, wherein each reproduction signal represents a wave propagating, along the associated direction, in a coefficients-based estimate of the acoustic field, with coefficients derived from the measurement signals.

3. The system according to claim 2, wherein the wave is a planar wave.

4. The system according to claim 1, wherein

E giving the coefficients-based estimate of the acoustic field, in the form of coefficients.

5. The system according to claim 2, wherein the coefficients-based estimate is constituted by spatio-temporal functions enabling any acoustic field to be described in time and in three dimensions.

6. The system according to claim 5, wherein the spatio-temporal functions are Fourier-Bessel functions.

7. The system according to claim 1, comprising a number of elemental sensors of one to five times the number of predetermined general reproduction directions.

8. The system according to claim 1, wherein the processing device applies a process to the measurement signals, which varies with the frequency of the measurement signals.

9. The system according to claim 1, further comprising a plurality of reproduction elements, each receives a respective reproduction signal and arranged according to the reproduction direction of the respective reproduction signal.

10. The system according to claim 1, wherein the single filtering matrix T is obtained by computation from the positions of an acquisition means and the reproduction direction.

11. A method for designing a system for determining reproduction signals of an acoustic field, the method comprising:

distributing elemental sensors in space at respective positions with respect to a center of the elemental sensors, according to a substantially non-regular distribution, in which, for the following three-dimensional coordinate systems: Cartesian, cylindrical or spherical, for at least one of the coordinates of the coordinate system, the values of the coordinates of the positions of all of the elemental sensors are distributed on distinct values and at a non-constant pitch, wherein the elemental sensors measure the acoustic field and deliver measurement signals, choosing a coefficients-based model, calculating a filter E provides coefficients for the coefficients-based model from the measurement signals, wherein the coefficients-based model and the coefficients form a coefficients-based estimate of the acoustic field, calculating a filter D provides reproduction signals forming a representation of the acoustic field, from the coefficients, providing a processing device from the filter E and the filter D, for processing the measurement signals in order to deliver a plurality of respective reproduction signals forming a representation of the acoustic field, wherein each reproduction signal is associated with a reproduction direction with respect to a given point in space, wherein the reproduction signals make reproduction elements reproduce the acoustic field upon each reproduction signal being delivered to a respective reproduction element orientated according to the reproduction direction associated with the reproduction signal, wherein providing the processing device comprise a calculating a single filtering matrix T, receiving as an input the measurements signals and delivering as an output the reproduction signals, and wherein T=DE, where:

E is an encoding matrix representative of the spatial configuration of an acquisition means, and D is a decoding matrix representative of the predetermined general reproduction directions.

12. The method according to claim 11, wherein each reproduction signal represents a wave propagating, along the associated direction, in a coefficients-based estimate of the acoustic field, with coefficients derived from the measurement signals.

13. The method according to claim 12, wherein the wave is a planar wave.

14. The method according to claim 11, wherein

E giving the coefficients-based estimate of the acoustic field, in the form of coefficients.

15. A method for determining reproduction signals of an acoustic field, comprising:

receiving measurement signals delivered by a plurality of elemental sensors, wherein the elemental sensors are distributed in space at respective positions with respect to a center of the elemental sensors, according to a substantially non-regular distribution, in which, for the following three-dimensional coordinate systems: Cartesian, cylindrical or spherical, for at least one of the coordinates of the coordinate system, the values of the coordinates of the positions of all of the elemental sensors are distributed on distinct values and at a non-constant pitch, processing, according to the three-dimensional positions of the elemental sensors, the measurement signals in order to deliver a plurality of reproduction signals forming a representation of the acoustic field, wherein each reproduction signal is associated with a reproduction direction with respect to a given point in space, wherein the reproduction signals make reproduction elements reproduce the acoustic field upon each reproduction signal being delivered to a respective reproduction element orientated according to the reproduction direction associated with the reproduction signal, wherein the processing comprises a single filtering stage by a filtering matrix T, receiving as an input the measurement signals delivering as an output the reproduction signals, and wherein T=DE, where:

E is an encoding matrix representative of the spatial configuration of an acquisition means, and D is a decoding matrix representative of the predetermined general reproduction directions.

16. The method according to claim 15, wherein each reproduction signal represents a wave propagating along the associated direction, in a coefficients-based estimate of the acoustic field, with coefficients derived from the measurement signals.

17. The method according to claim 16, wherein the wave is a planar wave.

18. The method according to claim 15, wherein

E giving the coefficients-based estimate of the acoustic field, in the form of coefficients.

19. The method according to claim 16, wherein the coefficients-based estimate is constituted by spatio-temporal functions enabling any acoustic field to be described in time and in three dimensions.

20. The method according to claim 19, wherein the spatio-temporal functions are Fourier-Bessel functions.

21. A method for checking the non-regular character of a network of elemental sensors ($\mathbf{2}_1$ to $\mathbf{2}_Q$), comprising:

in considering the network in a first usual coordinate system;

in checking via computer the values of the positions of all of the sensors ($\mathbf{2}_1$ to $\mathbf{2}_Q$) in accordance with a first coordinate of the coordinate system;

if the values of the first coordinates are neither constant nor distributed at regular intervals, the network is called non-regular in the current coordinate system and the method is repeated in another coordinate system;

if the values of the first coordinates are either constant or distributed at regular intervals, the values of the positions of the sensors are checked in accordance with a second coordinate of the coordinate system;

if the values of the second coordinates are neither constant, nor distributed at regular intervals, the network is non-regular in the current coordinate system and the method is repeated with another coordinate system;

if the values of the second coordinates are either constant or distributed at regular intervals, the values of the positions of the sensors are checked in accordance with a third coordinate of the coordinate system;

if the values of the third coordinates are neither constant nor distributed at regular intervals, the network is non-regular in the current coordinate system and the method is repeated in another coordinate system;

if, for the first, second and third coordinates, the values of coordinates of the positions of all of the sensors are either constant or distributed at regular intervals, the network is regular in the current coordinate system;

if in any one of the usual coordinate systems, the network is regular, it is called regular; and if the network is non-regular in each of the usual coordinate systems, it is called non-regular.

* * * * *